US005780726A

United States Patent [19]

Bastawros et al.

[11] Patent Number: 5,780,726

[45] Date of Patent: Jul. 14, 1998

[54] METHOD OF DETERMINING SLOPE ANGLES OF IMPRESSION WALLS AND DEPTHS OF IMPRESSIONS ON AN EMBOSSED SHEET SURFACE

[75] Inventors: Adel F. Bastawros; John G. Speer, both of Bethlehem, Pa.

[73] Assignee: Bethlehem Steel Corporation

[21] Appl. No.: 697,562

[22] Filed: Aug. 28, 1996

Related U.S. Application Data

[62] Division of Ser. No. 409,219, Mar. 23, 1995, Pat. No. 5,552,235.

[51] Int. Cl.[6] ..... G01N 33/20

[52] U.S. Cl. ..... 73/105; 72/31.01; 73/159

[58] Field of Search ..... 73/104, 105, 159; 364/562; 72/31.01; 427/8; 428/612, 687; 492/9, 10

[56] References Cited

U.S. PATENT DOCUMENTS

| | | | |
|---|---|---|---|
| 3,087,329 | 4/1963 | Von Grodek et al. | 73/105 |
| 3,123,999 | 3/1964 | Judd | 73/105 |
| 3,313,149 | 4/1967 | Spragg | 73/105 |
| 3,372,578 | 3/1968 | Harmon | 73/105 |
| 3,543,571 | 12/1970 | Whitehouse | 73/105 |
| 3,583,216 | 6/1971 | Milewski | 73/105 |
| 3,754,873 | 8/1973 | Bills et al. | 29/183.5 |
| 4,059,000 | 11/1977 | Bodner | 72/197 |
| 4,092,842 | 6/1978 | Oser et al. | 72/379 |
| 5,182,171 | 1/1993 | Aoyama et al. | 428/623 |
| 5,272,443 | 12/1993 | Winchip et al. | 73/105 X |

*Primary Examiner*—Thomas P. Noland

[57] ABSTRACT

An embossed cold rolled metal (e.g. steel) sheet for use in manufacturing appliances and method of making same wherein the surface attributes of the embossed sheet are optimized to improve corrosion resistance of the painted product, promote uniform paint coverage of the sheet surface, reduce paint consumption, enable repainting without loss of pattern crispness, and provide consistent and aesthetically pleasing appearance of the painted sheet. The embossed sheet has a plurality of plateaus and impressions defined therein in a manner such that the arithmetic average surface roughness (Ra) of the plateaus is from about 50 to 100 microinches, the maximum impression depths over a given area are from about 0.0025 to 0.0032 inches, the impression walls define maximum slopes of from about 8–17 degrees, and there are no sharp corners or ridges at the transition points between plateaus and impressions.

1 Claim, 3 Drawing Sheets

METHOD OF DETERMINING SLOPE ANGLES OF IMPRESSION WALLS AND DEPTHS OF IMPRESSIONS ON AN EMBOSSED SHEET SURFACE

This is a division of application Ser. No. 08/409,219, filed Mar. 23, 1995 and now U.S. Pat. No. 5,552,235.

This invention relates to embossed metal sheets and a method for manufacturing same. More particularly, this invention relates to embossed steel sheets having improved paintability, corrosion resistance, and appearance, and a method for manufacturing same.

BACKGROUND OF THE INVENTION

Embossed cold rolled metal (e.g. steel) sheets are commonly used in many applications, one such use being for appliance (e.g. microwave, refrigerator, etc.) panels. FIGS. 1 and 2 show a typical prior art embossed sheet of cold rolled steel, with FIG. 1 being a top photographic view of the unpainted sheet and FIG. 2 being a side enlarged cross sectional view of the sheet with paint applied thereto. The cold rolled sheet includes steel substrate 3 covered with a layer of paint 5. In the embossing process, a plurality of impressions 7 are formed in steel substrate 3 by working rolls (not shown). Plateaus 9 are formed between impressions 7.

In the manufacture of cold rolled steel sheets, it is often desirable to control the surface finish (i.e. embossing) of substrate 3 in order to enhance the appearance and performance of the sheet in subsequent operations. Embossing is commonly done in the final stages of manufacture by rolling the strip or sheet 3 between a pair of opposing working rolls, one of which is textured of predetermined configuration so as to impress the embossing pattern into a surface of sheet 3. See, for example, U.S. Pat. Nos. 4,059,000 and 4,092,842.

Surface texturing of the working roll is an established technology in embossing steel sheets and in the printing industry. The protrusions (i.e. surface texture) defined on the working roll are often created via acid etching. The surface texture of the working roll is transferred to the cold rolled sheet during the embossing process, thereby forming the pattern.

Unfortunately, prior art embossed cold rolled steel sheets, such as the one illustrated in FIGS. 1–2, suffer at least from the following problems: (i) non-uniform paint coverage of the surface; (ii) high paint consumption; (iii) premature corrosion (e.g. rust) due to paint thinning at the transitions 11 from plateaus 9 to impressions 7 as shown in FIG. 2; (iv) discoloration when light paint colors are used due to the dark base metal showing through the thin paint at transition points 11; (v) loss of the embossed pattern after painting; and (vi) not allowing for re-painting without negatively impacting the aesthetic appearance of the sheet.

The inclination (i.e. slope) of surfaces 13 of substrate 3 between plateaus 9 and impressions 7 has been found by the instant inventors to be an important surface feature with respect to premature corrosion, discoloration, and non-aesthetically pleasing appearance. Unduly high slopes of surfaces 13 cause paint 5 to flow downward into impressions 7, leading to paint thinning at transition points 11 between plateaus 9 and impression 7 (see FIG. 2), which makes these sites prone to premature corrosion. Additionally, when light colored paint is used, thinner paint at transition points 11 leads to non-uniform appearance due to the dark base metal of substrate 3 showing through the thin paint at these points. Slopes which are too low, on the other hand, cause a loss of crispness in the painted embossed surface, which leads to a less aesthetically pleasing appearance.

The depth of impressions 7 relative to the tops of plateaus 9 has also been found by the instant inventors to be an important surface characteristic with respect to paint consumption, allowance of re-painting, and paint thinning across the plateaus. Impressions 7 which are too deep create deep pockets for high paint consumption, and/or excessive paint flow from the tops of plateaus 9 into impressions 7. This creates thinner paint coverage across plateaus 9 and transition points 11. Impressions 7 which are too shallow, on the other hand, cause loss of the embossed pattern after painting, and prevent repainting by negatively affecting the appearance of the painted surface.

Surface roughness of plateaus 9 is another characteristic which has been found by the instant inventors to be important with respect to appearance and paint adhesion problems. Average surface roughness values (Ra) on plateaus 9 which are too low cause paint 5 to flow rather easily down and across surfaces 13 into impressions 7 thus leading to thin paint coverage across plateaus 9 and transition points 11. This gives rise to paint adhesion and corrosion problems. On the other hand, average roughness values which are too high, although favorable from a paint flow point of view, lead to large variations in the appearance of the painted cold-rolled embossed steel sheet. Average surface roughness (Ra) is discussed, for example, in U.S. Pat. Nos. 3,754,873 and 5,182,171.

The sharp corners or ridges at points 11 shown in prior art FIG. 2 lead to undesirably thin paint coverage at these points, thereby rendering them susceptible to premature corrosion.

In sum, prior art cold rolled embossed steel sheets suffer from the above referenced problems. In view of this, there exists a long felt need in the art for a paintable cold rolled embossed steel sheet and method of making same whereby the sheets are manufactured in order to achieve (i) uniform paint coverage across all surfaces; (ii) acceptable paint consumption; (iii) no premature corrosion due to paint thinning at transition points; (iv) improved aesthetic and color appearance; and (v) capability to be repainted without negatively impacting the appearance of the embossed sheet.

SUMMARY OF THE INVENTION

Generally speaking, this invention fulfills the above-described needs in the art by providing an embossed metal sheet comprising:

a) plateau portions defined on the surface of the embossed metal sheet;

b) impressions defined in the surface of the embossed sheet between adjacent plateau portions, each of the impressions having a bottom area and an impression wall connecting the bottom area to the adjacent plateau portions, the vertical distance between the impression bottoms and the plateau portions defining the depth of the impressions; and c) wherein the maximum depths of the impressions are from about 0.0025 to 0.0032 inches and the impression walls have maximum slope angles of from about 8 to 17 degrees with respect to the horizontal.

In certain further embodiments of this invention, the arithmetic average surface roughness of the plateau portions is from about 50 to 100 microinches.

In still further preferred embodiments of this invention, the embossed sheet is made of low carbon cold rolled steel of drawing quality.

This invention further fulfills the above-described needs in the art by providing a method of making an embossed steel sheet having surface characteristics optimized to improve corrosion resistance and promote substantially uniform paint coverage of the sheet surface, the method comprising the steps of:

a) providing a steel sheet;

b) embossing the steel sheet by rolling it using a textured working roll so that the resulting embossed steel sheet has a plurality of plateaus and impressions defined therein; and c) controlling the rolling force during embossing so that the maximum depth of the impressions is from about 0.0025 to 0.0032 inches.

This invention further fulfills the above-described needs in the art by providing an embossed steel sheet adapted to be painted, the steel sheet comprising:

a plurality of plateaus and corresponding impressions in the steel sheet defining an embossed pattern, each impression having an impression wall connecting the bottom of the impression to an adjacent plateau with the vertical distance between the adjacent plateau and the bottom of the impression defining the depth of the impression; and wherein the arithmetic average surface roughness (Ra) of the plateaus is from about 50 to 100 microinches, and the maximum depth of the impressions is from about 0.0025 to 0.0032 thereby improving corrosion resistance and providing a consistent and aesthetically pleasing appearance of the embossed steel sheet when painted.

This invention will now be described with respect to certain embodiments thereof, accompanied by certain illustrations wherein:

IN THE DRAWINGS

FIG. 3(*b*) is a slope versus profile length graph of the embossed steel sheet of FIG. 3(*a*), wherein FIGS. 3(*a*) and 3(*b*) correspond to one another with respect to profile length;

DETAILED DESCRIPTION OF CERTAIN EMBODIMENTS OF THIS INVENTION

Figure 1:
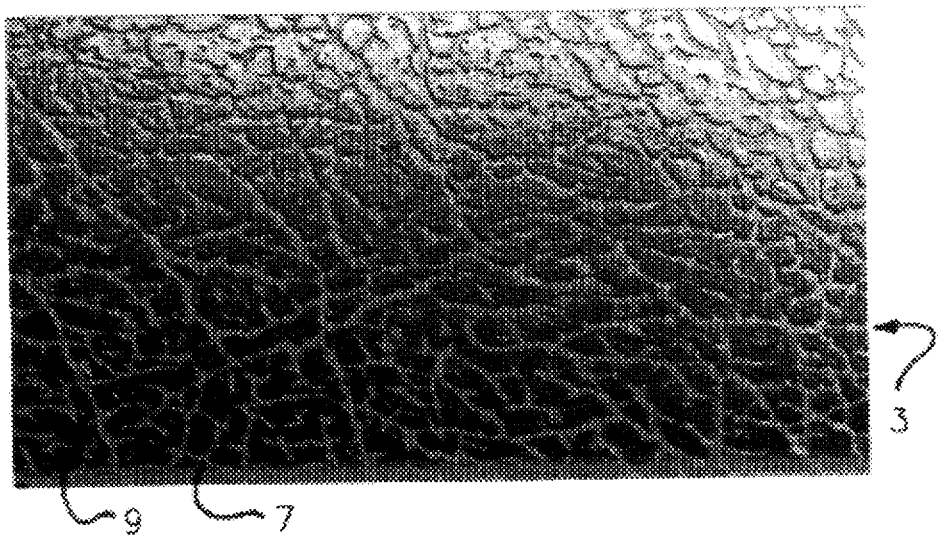
Fig. 1 (Prior Art)
FIG. 1 is a photographic top view of a prior art embossed sheet of unpainted cold rolled steel.

In the accompanying drawings, like reference numerals indicate like parts throughout the several views.

Figure 3A:
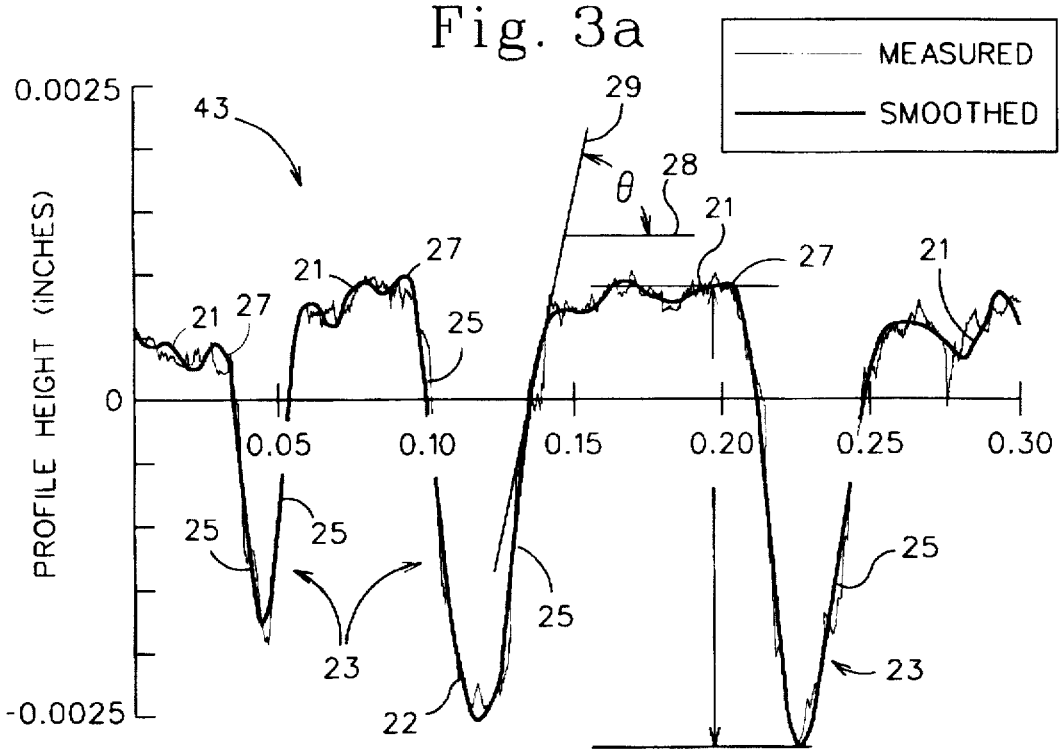
FIG. 3(*a*) is a profile height versus profile length graph of an unpainted embossed cold-rolled steel sheet according to an embodiment of invention.
Figure 3B:
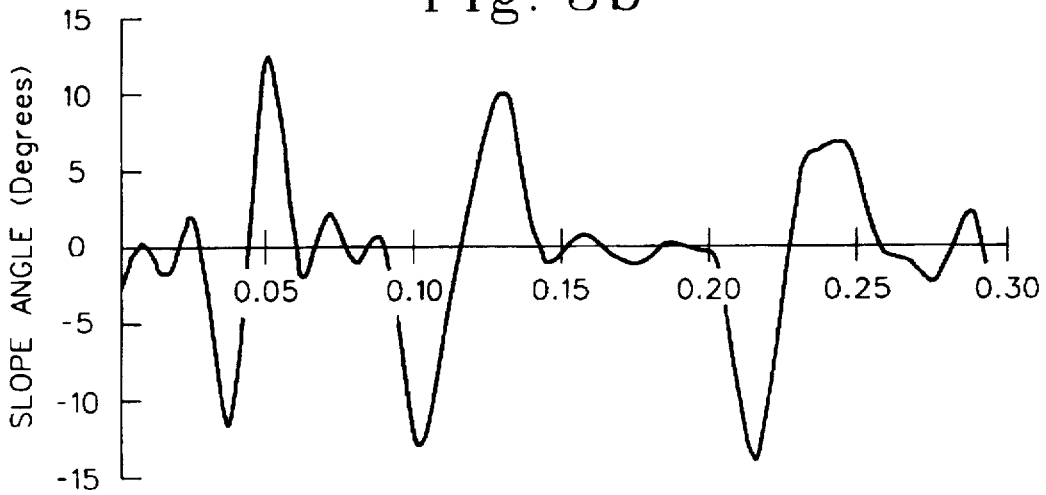

FIG. 3(*a*) is a graph illustrating the profile height (inches) as a function of profile length (inches) of a section of unpainted deoiled embossed cold rolled sheet steel 43, (FIG. 5) according to an embodiment of this invention. Sheet 43 is of drawing quality low carbon steel, or other substrate according to certain embodiments of this invention. This figure is similar to a cross-sectional view except that actual distances are plotted on the x and y axes, and the axes define different distances.

As best shown in FIGS. 3(*a*) and 4, unpainted embossed steel sheet 43 includes plateau portions 21, impressions 23, and impression walls or surfaces 25. Impressions 23 are defined in the steel substrate between adjacent plateaus 21, so that the bottoms 22 of impressions 23 represent the lowest elevations and the tops of plateaus 21 define the highest elevations of the embossed steel substrate. Impression walls 25 define the surfaces of transition between plateaus 21 and bottoms 22 of impressions 23, whereby plateaus 21 end at transition points 27 where impression walls 25 drop to form impressions 23. The depth D of a particular impression 23, as best shown in FIG. 3(*a*), is the total vertical distance from the top of a plateau 21 to the bottom 22 of an impression 23. After steel substrate 43 is embossed using a textured working roll 41 (see FIG. 5), the sheet surface including plateaus 21 and impressions 23 is covered with a layer of paint in a conventional manner after one or more fabrication steps.

Both measured and smoothed plots are shown in FIG. 3(*a*). The measured plot results from a profilometer recording the vertical displacement of a stylus passed over the surface of the sheet. Fine surface details in the measured profile which do not contribute to the determination of depth D and slope θ are then eliminated or filtered numerically in order to come up with the smoothed plot. The smoothed plot is then used to determine depth D and slope θ.

As can be seen in FIG. 3(*a*), each impression wall 25 defines a particular slope or inclination angle θ. The slope angle θ of each impression wall 25 is defined as the angle between the horizontal 28 and a straight line 29 which is tangent to wall 25. Straight line 29 defines a tangent to impression wall 25 at an arbitrary point along the wall surface that is indicative of the average wall 25 slope.

The maximum impression depths D in the embossed sheet, according to this invention, range from about 0.0025 to 0.0032 inches. The largest depth D shown in the FIG. 3(*a*) embodiment is about 0.0032 inches. Maximum impression depths D in about the 0.0025 to 0.0032 inch range assure moderate paint consumption, uniform appearance of the painted pattern, and allow for re-painting when necessary without loss of the embossed pattern which would otherwise be caused by paint filling the bottoms 22 of impressions 23. Maximum impression depths D larger than about 0.0032 inches create impressions which are too deep, thereby providing paint pockets which either increase paint consumption or permit excess paint to flow from the plateaus 21 down into the impressions 23 thus leading to thinner paint coverage on the plateaus 21 and transition points 27. On the other hand, maximum impression depths D less than about 0.0025 inches may cause the embossed pattern to be reduced or even lost after painting, and do not permit re-painting without negatively impacting on the appearance of the re-painted embossed surface. In view of the above, maximum impression depths D from about 0.0025 to 0.0032 inches are important embossed sheet surface attributes for maintaining acceptable paint consumption, reducing premature corrosion, creating an aesthetically pleasing appearance, and allowing re-paintability.

As used herein, maximum impression depth means the depth of the impression which provides the maximum or greatest vertical dimension between a plateau 21 and its impression bottom 22. If the maximum impression depth falls within the selected range, then we have found that to be sufficient. Preferably there are between three and nine traces made with the profilometer across the sample in determining the maximum impression depth. Those traces are also used to determine the maximum slope.

The range for the arithmetic average surface roughness (Ra) for the plateaus 21 on the embossed steel sheet 43 is from about 50 to 100 microinches according to the invention. The arithmetic average surface roughness values (Ra) on plateaus 21 in FIG. 3(*a*) are within this range. Adequate surface roughness of plateaus 21 restrains the paint from too easily flowing downward into impressions 23 via impression walls 25. Additionally, surface roughness (Ra) within this range improves paint adhesion to the embossed sheet, and enhances the appearance of the painted surface. Average roughness values (Ra) which are below this range permit the paint to too easily flow down into impressions 23 leading to thin glossy paint coverage across plateaus 21 and transition points 27, thereby rendering the embossed sheet susceptible to premature corrosion and non-aesthetically pleasing appearance. Such thin glossy paint coverage of plateaus 21 also creates paint adhesion problems. On the other hand, average surface roughness values (Ra) above this range, while favorable from a paint flow point of view, lead to undesirably large variations in the appearance of the painted embossed sheet. In view of the above, arithmetic average surface roughness values (Ra) within the range of from about 50–100 microinches are important for ensuring satisfactory paint flow and adhesion, as well as enhanced appearance and reduced premature corrosion of the embossed steel sheet.

Figure 2:
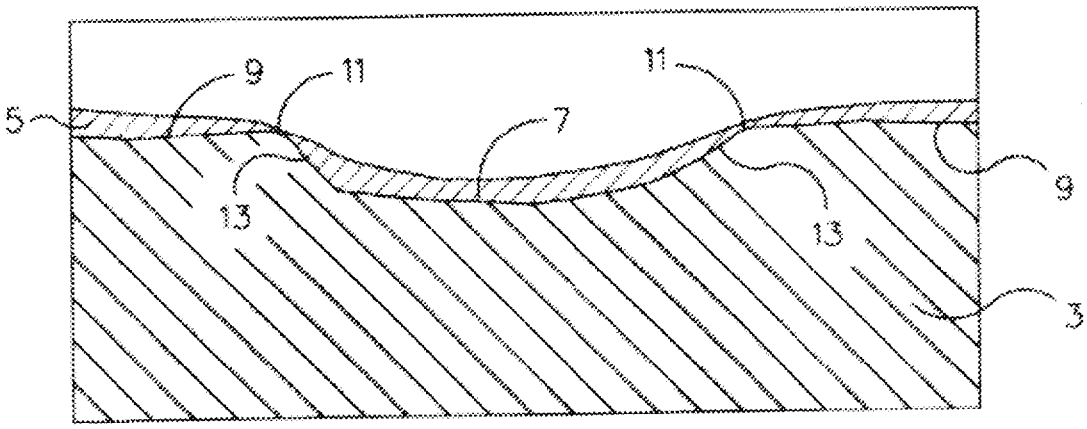
Fig. 2 (Prior Art)
FIG. 2 is a magnified side elevational cross-sectional view of the prior art painted embossed steel sheet shown in FIG. 1.

As shown in the plot of FIG. 3(*a*), there are no sharp corners or ridges at the transition points 27 between plateaus 21 and impressions 23. This is unlike the prior art embossed sheet of FIG. 2, which has sharp points at transitions 11. The sharp corners of the prior art lead to thinner paint coverage at the transition points, thereby creating sites for premature corrosion. When light colored paint is used, the bare metal of the prior art steel substrate often can be seen through the thin paint at such points, thereby creating a non-uniform appearance. Accordingly, the elimination of sharp corners and ridges at transition points 27 is an important surface attribute for improving the painted embossed sheet's susceptibility to premature corrosion and non-uniform appearance.

FIG. 3(*b*) is a graph of slope (degrees) versus profile length (inches) for the embossed unpainted steel sheet of FIG. 3(*a*). The slope or inclination angle e of FIG. 3(*a*) is plotted in FIG. 3(*b*) as a function of the length of the embossed sheet for the portion profiled in FIG. 3(*a*). The maximum slope angle θ range for impression walls 25 is from about 8 to 17 degrees (most preferably from about 8 to 13 degrees) with respect to the horizontal for this invention. As illustrated, the slope angle θ fluctuates around zero across plateaus 21, with the prolonged slope fluctuations and higher slope angles occurring throughout impressions 23 between the opposing transition points 27 defining each impression. Starting at the axis intersection of the FIG. 3(*b*) graph and moving to the right across the embossed surface along the length axis, the slope angle θ remains about zero across the first plateau 21, but then dips down to about −12° across the first downward sloping impression wall 25. Then, at the bottom of the first impression 23, the slope angle θ changes direction and changes to about +13° (maximum angle) across the upwardly sloping impression wall 25 which proceeds to the second plateau. At the top of the second plateau 21, the slope comes down and stays around zero degrees until the next transition point 27. The maximum slope angle θ detected in FIG. 3(*b*) is within the preferred range.

Slope or inclination angles θ of walls 25 in about the 8 to 17 (more preferably about 8 to 13) degree range create uniform paint coverage of the embossed surface. Slopes higher than this may cause the paint to flow downward into impressions 23, thereby leading to paint thinning at transition points 27 between plateaus 21 and impressions 23. This renders points 27 susceptible to premature corrosion and causes the dark bare metal to be seen when light colored paint is used. Slopes lower than the prescribed range, on the other hand, cause loss of crispness of the painted embossed surface, thereby creating a less aesthetically pleasing appearance.

In sum, cold rolled embossed steel sheets according to this invention are manufactured so as to have the following surface characteristics:

(i) maximum impression depth D range of from about 0.0025 to 0.0032 inches;

(ii) arithmetic average plateau surface roughness (Ra) range of from about 50 to 100 microinches;

(iii) maximum slope or inclination angle of impression walls 25 of from about 8 to 17 degrees with respect to horizontal, most preferably from about 8 to 13 degrees; and (iv) no sharp corners or ridges at the transition points 27 between the plateaus and impressions.

When metal embossed sheets are manufactured so as to have the above-identified four surface attributes, the resulting surface is optimized to improve corrosion resistance, promote uniform paint coverage of the surface, reduce paint consumption, enable repainting without loss of the pattern crispness, and provide consistent and aesthetically pleasing appearance.

Figure 4:
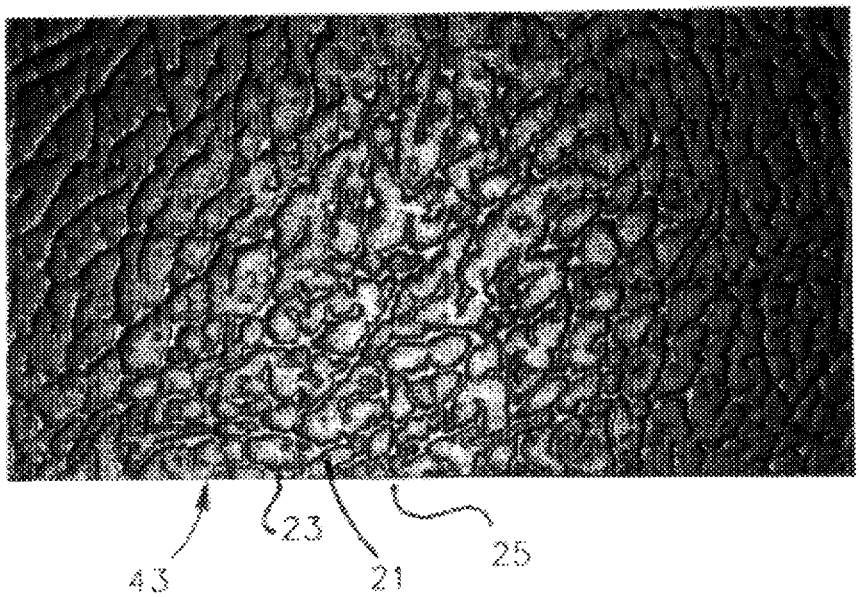
FIG. 4 is a top photographic view of an unpainted embossed steel sheet according to an embodiment of this invention.

FIG. 4 is a top photographic view of an unpainted embossed steel sheet 43 having the above-listed surface characteristics. When compared to FIG. 1, it can be seen that the FIG. 4 sheet has superior aesthetic appearance characteristics in that it has better texture and more plateau surface roughness than the prior art. Also, the transition points are rounded instead of sharp.

Figure 5:
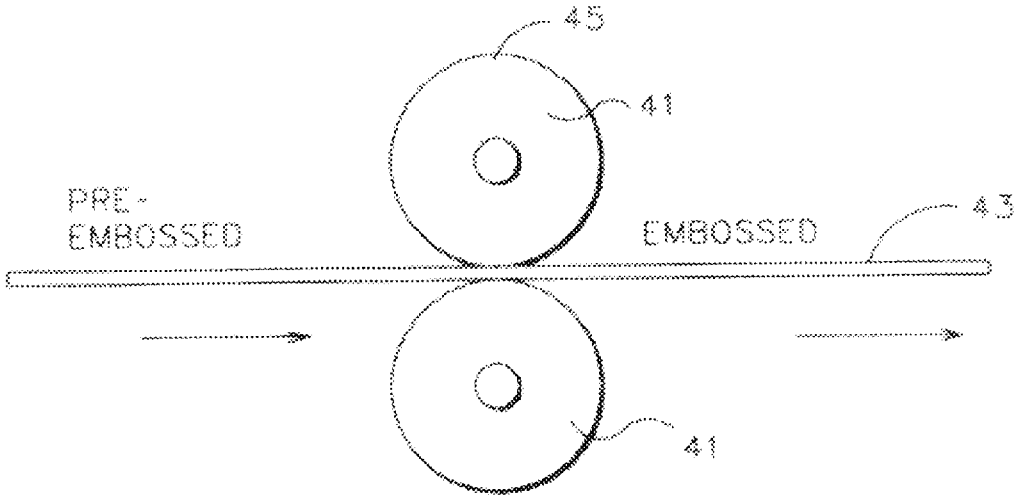
FIG. 5 is a schematic side view of a steel sheet being fed between a pair of opposing working rolls, one of which is textured, during the embossing process.

The above-listed embossed sheet surface characteristics are controlled and achieved by controlling the surface attributes (mountains, valleys, etc.) of one of the working rolls 41 used in the embossing process (see FIG. 5). One of rolls 41 has an embossing surface texture defined therein, while the other roll 41 is flat. The surface texture of working roll 41 typically is created via acid etching in a conventional manner. The rolling process itself is controlled so as to achieve proper transfer of the working roll surface texture to steel sheet 43.

The slope angle θ of impression walls 25 on embossed sheet 43 is controlled by defining the slopes of the walls of the protrusions on working roll surface 45. These are controlled during texturing of working roll surface 45 by adjusting the acid concentration, rate of metal removal from the working roll surface, and the number of etching steps, these techniques being known in the art.

The impression depth D on embossed steel sheet 43 is controlled by adjusting the protrusion height on working roll surface 45, and by controlling the rolling force during the embossing process. This is accomplished by adjusting the total etching time in the acid bath. The target value for the protrusion height under normal circumstances is the upper limit of the desired depth range (i.e. about 0.0032 inches) so as to provide for roll wear over the life of the textured working roll.

The roughness of working roll surface 45 (and thus the sheet) is controlled by grit blasting the roll surface prior to initial use and then optionally chromium plating the surface 45 to harden it and preserve the roughness over the working roll life. Grit size used in the blasting process is chosen in a manner such that the roughness created on the roll surface is within the desired roughness range. Roughness of working roll surface 45 is replenished by light blasting whenever it (i.e. roughness) approaches the lower end of the prescribed range due to wear.

Sharp corners and ridges on steel sheet 43 are avoided by (i) grit blasting working roll surface 45, prior to chromium plating, in order to round any sharp corners which may have been created during the acid etching process; and (ii) adjusting the rolling forces to ensure full contact between the working roll textured surface 45 and the steel sheet surface during rolling. Step (ii) is carried out in particular because partial indentations lead to sharp corners and ridges in sheet 43 due to material relief.

While the embodiments set forth above involve embossed steel sheets, the sheets may be made of other materials (e.g. aluminum, copper, or non-metals such as plastic) according to the invention.

Once given the above disclosure therefore, various other modifications, features, or improvements will become apparent to the skilled artisan. Such other features, modifications and improvements are thus considered to be a part of this invention, the scope of which is to be determined by the following claims.

We claim:

1. A method of determining slope angles θ of impression walls and depths D of impressions on the surface of an embossed sheet, the method comprising the steps of:

a) providing an embossed sheet;

b) measuring the surface profile of the embossed sheet by measuring the vertical displacement of a stylus passed over the embossed surface of the sheet thereby determining a measured profile signal;

c) obtaining a smoothed signal by numerically filtering out of the measured profile signal fine surface details which do not substantially contribute to the determination of depth D and slope θ thereby eliminating such details from the measured profile signal; and d) determining the depth D of impressions, and slope angles θ of impression walls of the embossed surface using the smoothed signal.

* * * * *